US008627571B2

(12) United States Patent
Rabinovich et al.

(10) Patent No.: US 8,627,571 B2
(45) Date of Patent: Jan. 14, 2014

(54) COMPACT KNIFE HOLDER

(75) Inventors: Semyon Rabinovich, Basking Ridge, NJ (US); Michael Rabinovich, Solon, OH (US)

(73) Assignees: Semyon Rabinovich, Solon, OH (US); Michael Rabinovich, Solon, OH (US)

( * ) Notice: Subject to any disclaimer, the term of this patent is extended or adjusted under 35 U.S.C. 154(b) by 535 days.

(21) Appl. No.: 12/655,701

(22) Filed: Jan. 7, 2010

(65) Prior Publication Data

US 2011/0162217 A1 Jul. 7, 2011

(51) Int. Cl.
*B26B 27/00* (2006.01)

(52) U.S. Cl.
USPC ..... 30/298.4; 30/296.1; D7/637

(58) Field of Classification Search
USPC ..... 30/298.4, 296.1; 248/37.3, 111; 211/70.7; D7/637–638; 206/553, 372, 206/373; 225/105
See application file for complete search history.

(56) References Cited

U.S. PATENT DOCUMENTS

| | | | | | |
|---|---|---|---|---|---|
| 768,266 | A | | 8/1904 | Carey | |
| 1,876,284 | A | | 9/1932 | Fried | |
| 1,946,779 | A | * | 2/1934 | Conway | 248/37.3 |
| 2,459,391 | A | | 1/1949 | Otis | |
| 2,479,181 | A | * | 8/1949 | Pavlack | 248/37.6 |
| 2,955,789 | A | | 10/1960 | Smith | |
| 3,966,055 | A | * | 6/1976 | Francavilla | 211/65 |
| 4,423,552 | A | * | 1/1984 | Bourgein et al. | 30/298.4 |
| 4,561,548 | A | * | 12/1985 | Call | 211/70.7 |
| 4,970,006 | A | * | 11/1990 | Martinez | 248/37.3 |
| 5,011,102 | A | * | 4/1991 | Kiefer | 248/37.3 |
| 5,050,749 | A | * | 9/1991 | Scaglione | 211/70.7 |
| 6,662,453 | B1 | * | 12/2003 | Stuckey et al. | 30/298.4 |
| 6,877,231 | B2 | * | 4/2005 | Rosenberg et al. | 30/298.4 |
| 7,434,693 | B2 | * | 10/2008 | Mosko | 206/553 |
| 2004/0031159 | A1 | * | 2/2004 | Rosenberg et al. | 30/298.4 |
| 2004/0148787 | A1 | * | 8/2004 | Rosenberg et al. | 30/298.4 |
| 2005/0241984 | A1 | * | 11/2005 | Mosko | 206/553 |
| 2006/0117575 | A1 | * | 6/2006 | Tetreault et al. | 30/298.4 |
| 2008/0060205 | A1 | * | 3/2008 | Schmidt et al. | 30/298.4 |
| 2011/0283547 | A1 | * | 11/2011 | Wang | 30/298.4 |

* cited by examiner

*Primary Examiner* — Omar Flores Sanchez
(74) *Attorney, Agent, or Firm* — Hahn Loeser & Parks LLP; Carlos P. Garritano

(57) ABSTRACT

A compact wall-mounted knife holder is formed from a stack of several plates separated by rows of narrow strips of material serving as spacers. The spaces between successive strips form channels for the knife blades. The rows of channels in adjacent pairs of plates crisscross in a lattice pattern but do not interfere with each other since the plates are stacked and each row occupies its own plane. At the same time, knives in all the rows utilize the same space on a wall surface, which makes the knife holder compact. The holder is attached to a wall so that the channels from both sides are at an angle that ensures that the force of gravity holds the knives in the channels. The front plate of the holder can be made from a decorative material and adorned with beatifying design.

16 Claims, 4 Drawing Sheets

COMPACT KNIFE HOLDER

BACKGROUND OF THE INVENTION

The invention concerns the household items, specifically the devices for storing knives used in houses and apartments.

Knife blocks are widely used in kitchens in residential housing; these blocks are sold either in a set with the knives or separately. Many patents and patent applications exist for various knife blocks offering a wide range of innovation, such as U.S. Pat. No. 4,423,552 that allows one to adjust the size of the slots to fit different knives, U.S. Pat. No. 6,877,231 that describes expandable blocks to accommodate a variable number of knives, U.S. Pat. No. 4,970,006 disclosing a block that can be disassembled for easy cleaning, US-2006/0117575A1 that proposes a block coupled with special cutlery implements, US-2008/0060205A1 that equips a block with magnets to hold knives securely and attach the block to any iron surface, U.S. Pat. No. 1,946,779 and U.S. Pat. No. 6,662,453, describing devices capable of accommodating a variety of implements in addition to knives, and US-2011/0283547 A1 that reduces the weight of a block and saves valuable wood by utilizing cork in its construction. A drawback of knife blocks is that they occupy space on a kitchen table or counter, where free space is typically scarce. Thus, many households forgo knife blocks and keep their knives in kitchen drawers along with other utensils. This practice creates a danger of getting an accidental cut when selecting an item from the drawer. Further the knives in a drawer are prone to blunt against other metal items. There are knife blocks that can be placed in the drawers but these blocks take up the entire drawer, which again wastes premium kitchen space that can usually be utilized more efficiently for other purposes. Thus, drawer-placed blocks have found limited acceptance.

Many patents exist for knife holders and knife racks that are wall mounted, for example, U.S. Pat. Nos. 768,266; 1,876,284; 2,459,391; 2,479,181 A; 2,955,789; 4,561,548 A; 5,050,749, 7,434,693. U.S. Pat. No. 5,011,102 further discloses a holder that can be mounted either horizontally on a work surface or vertically. However, these holders do not find usage in residential kitchens because of their large size relative to the capacity and/or industrial appearance. In particular, a magnetic wall mounted knife holder made by Würsthof is commercially available. This holder, in addition to the above-mentioned drawbacks, is also unsafe: it leaves the knife blades open and does not exclude a possibility that a knife may fall off due to an accidental disturbance and hurt a person's foot or get damaged. Further patents target holders for instruments other than knives; for example U.S. Pat. No. 3,966,055 discloses a holder for dental utensils with a beautified front plaque that encourages the use of the utensils. However, they do not address the aforementioned drawbacks of knife holders.

SUMMARY OF THE INVENTION

This invention proposes a new wall-mounted knife holder, which comprises a pack of several plates separated by narrow and thin strips as spacers. The strips separating a given pair of plates run preferably in parallel from one edge of the two plates to the other. The space between two parallel strips forms a channel for the knife blade. Furthermore, the strips separating any two adjacent pairs of plates run across each other thus forming crisscrossed channels. For example, a pack of three plates forms two plate-pairs and two rows of parallel channels. Channels in one row crisscross channels in the other row but because they belong in different planes in space they do not intersect. Thus, knives using these channels do not touch each other.

The holder is attached to a wall so that the channels from both sides are at an angle that ensures that the force of gravity, working with the strips, holds the knives securely in the channels. The front plate of the holder can be made from a decorative material and adorned with various ornaments or other beatifying design.

The presented knife holder has the following advantages over known wall-mounted holders:

1. The knife blades in the holder are fully concealed and thus the holder is safe.
2. The knives are inserted into the holder from two sides so that the handles of all knives are unblocked and equally accessible.
3. The knives in the holder are physically separated into two groups allowing a reliable separation of the knives, e.g., the knives for prepared food from those for raw meats as recommended by hygienic considerations, or the knives used for meats from those used for cheeses as demanded in Jewish observances.
4. The wall space occupied by the knife holder is not wasted because the front plate could be used to attach hooks for other kitchen items such as towels, brushes, sponges, etc. Or alternatively, this plate can be used for a photograph, a picture, or another beatifying item.
5. The front plate, made, e.g., from polished wood or other decorative material, can become a design element that not only does not clash with but also beautifies residential kitchen appearance.
6. The presented holder can be quite thin and thus does not protrude appreciably from the wall on which it is mounted. For example, a two-row holder can be less than 25 mm thick (two 5 mm plates, one 7 mm plate, and two rows of 3 mm spacer strips).

DESCRIPTION OF THE PREFERRED EMBODIMENT

Figure 1:
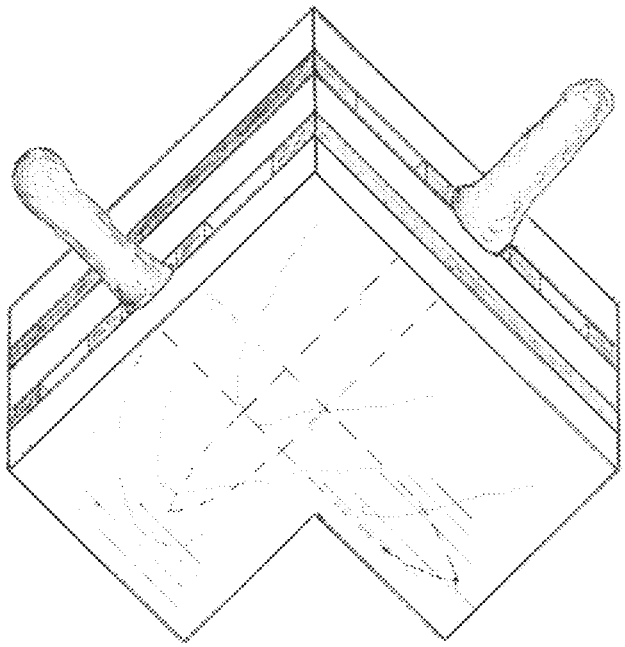
FIG. 1 is a front elevation view of a knife holder made in accordance with the present invention, which is shown holding 2 knives, one from each side.
Figure 2:
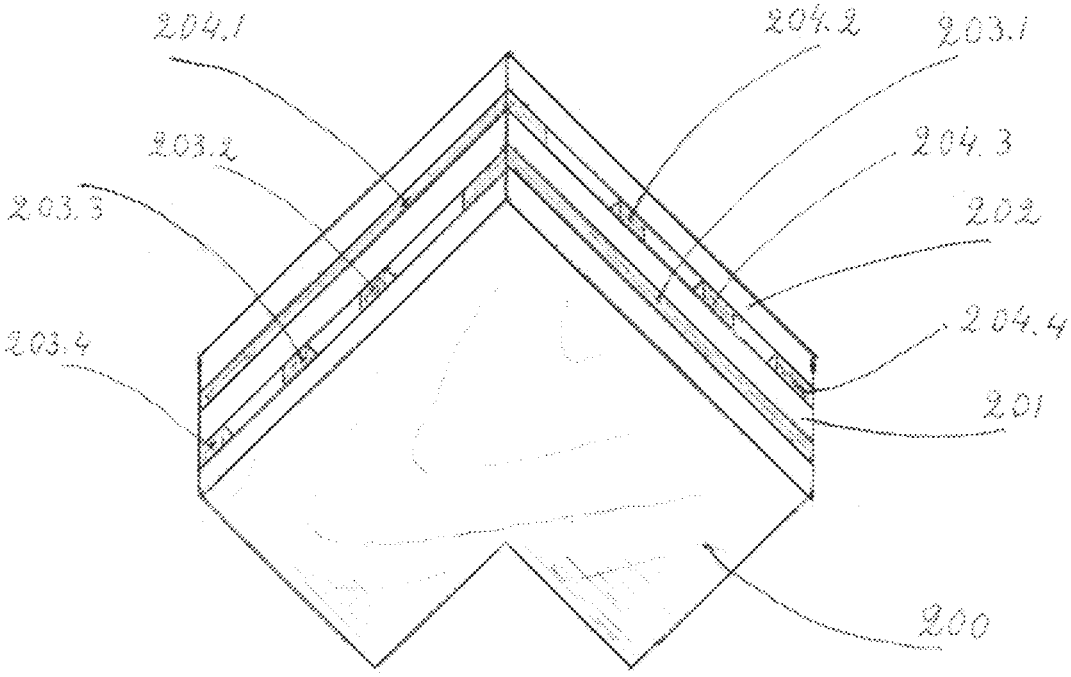
FIG. 2 is a front elevation view of a knife holder made in accordance with the present invention, which has one row of channels on each side.
Figure 3:
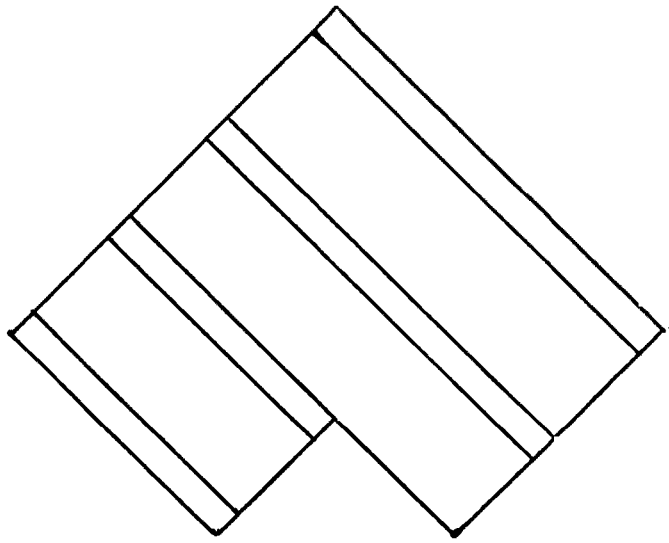
FIG. 3 is a front view of the middle plate with attached spacer strips.
Figure 4:
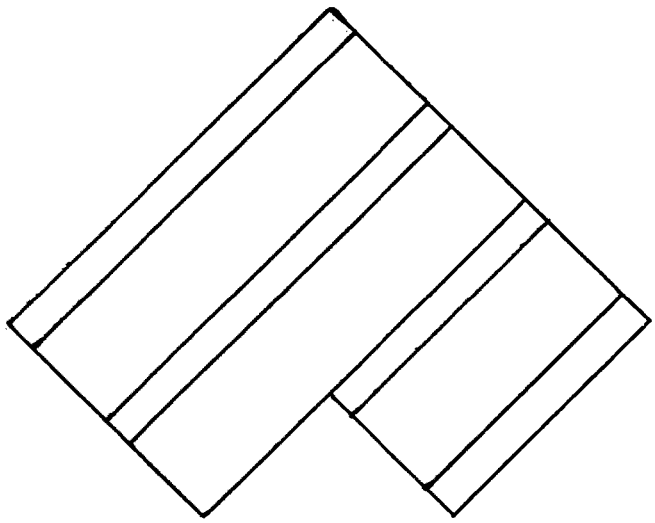
FIG. 4 is a front view of the back (wall-adjacent) plate with attached spacer strips.
Figure 3B:
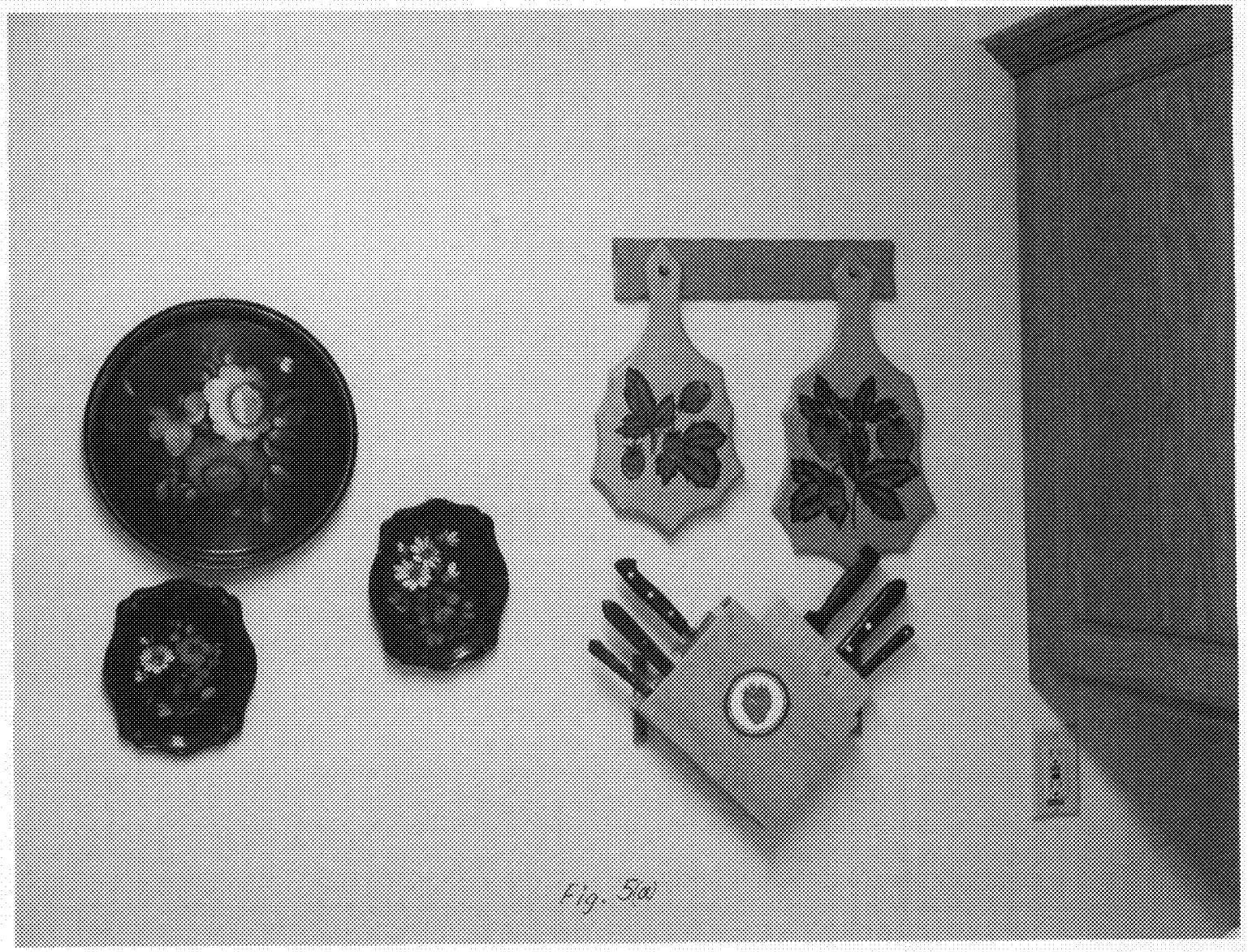

FIG. 1 shows an overall view of the knife holder made in accordance with the present invention. It shows two knives inserted into the holder from each side. FIG. 2 clarifies the design of the holder made in accordance with the present invention. It shows two rows of channels from each side of the holder. The holder consists of three plates 5, 6, and 7, and two rows of spacer strips, 8 and 9, between these plates. In the embodiment described, all plates have the same shape, which is shown in FIGS. 3 and 4. To the plates 7 and 6 are glued narrow and thin spacer strips, although it should be understood that strips could be glued to either one of their adjacent plates. In this embodiment, the strips on each plate run from one edge of the plate to the other; however in another embodiment it might be desirable to make the strips protrude outside the edges of the plates so that the protruding ends of the strips provide easy guidance to the user as to where to insert the knives into the holder. FIGS. 3 and 4 give the front view of the middle and the last plates from the side where the strips are attached. Thanks to the spacer strips, when the plates are composed into a pack, through channels are formed. One row of channels is formed between the plates 5 and 6, and the other between the plates 6 and 7. As a result, one row of channels is situated closer to the front panel than the other row of channels, and the knives in each row are reliably separated by plate 6.

Unlike other plates, the back plate 7 must have thickness of at least half that of the thickest knife handle.

The attachment of the strips to the plates can be done with glue, screws, or staples or any other permanent means.

The components listed above, attached to each other, form the knife holder. The holder has through channels into which the knives are inserted from two sides. The open bottom side of the channels prevents the accumulation of dust and allows for easy cleaning of the channels.

The size of the plates (and hence the holder) is determined by the length of the knives to be stored in it, and the space between spacer strips in the same row (e.g., the width of the channels) is determined by the width of the knives. In the embodiment shown in FIG. 2, the channels for long knives are situated in the upper part of the holder, while the channels for short knives are in the bottom part. This makes the bottom parts of the plates empty and they can be removed. In FIG. 2, this removed part of the plates is made in the shape of a square, but it can follow a different design, e.g., following a section of a circle or another shape.

A person skilled in the art will appreciate that the described invention allows for wide variety of designs. The channels in the holder can be formed by means other than the spacer strips; for example, they can be formed by cutting out depressions from the plates. The pack of plates can have not three but a greater number of plates; the plates can have different shapes as long as the angles of the channels are sufficient for their steady positioning in the holder. A single holder may also incorporate a wide variety of channel lengths and widths.

The plates of the holder can be made of wood, plywood, molded plastic, composite materials, metal, or other material, and one pack may include plates made of different materials. The space strips must be made from a material that is less hard than the knife blades such as wood or plastic of similar density so that the blades would not blunt when touching the strips.

The holder is mounted on a wall in a way that the channels from both sides are at an angle to the horizontal line that ensures that the force of gravity, by pressing the knives against the spacer strips, holds the knives securely in the channels. In the preferred embodiment, the mounting positions the channels on both sides at the same angle to the horizontal line. Wall mounting can be done in any way used to mount shelves on the walls. A simple way is to make the wall-side plate slightly larger than the rest of the pack. Then this plate can be fitted with a few holes for screws. Because the plate is larger than the rest of the pack, these screws will be easily accessible and can be used to conveniently attach the holder to the wall.

The front plate can be laminated or made from decorative wood or material, turning the knife holder into an accessory accent of the kitchen interior design.

The holder can be retailed in a disassembled form, and a kit to be glued together by the consumer. This would allow the consumer to customize the channel widths to correspond to the specific knives to be stored in the holder.

In mass production of the holder described in the present invention, some of the internal plates can be made without spacers, while other plates would be made with spacers from both sides. For example, on FIG. 2, the holder has one internal plate 6 with spacers on one side. Instead, this plate could have spacers on both sides, and then neither the front nor the back plates would have any attached spacers. Such a plate with spacers on both sides can be pressed from plastic or other moldable or pressable material as one unit.

Figure 5B:
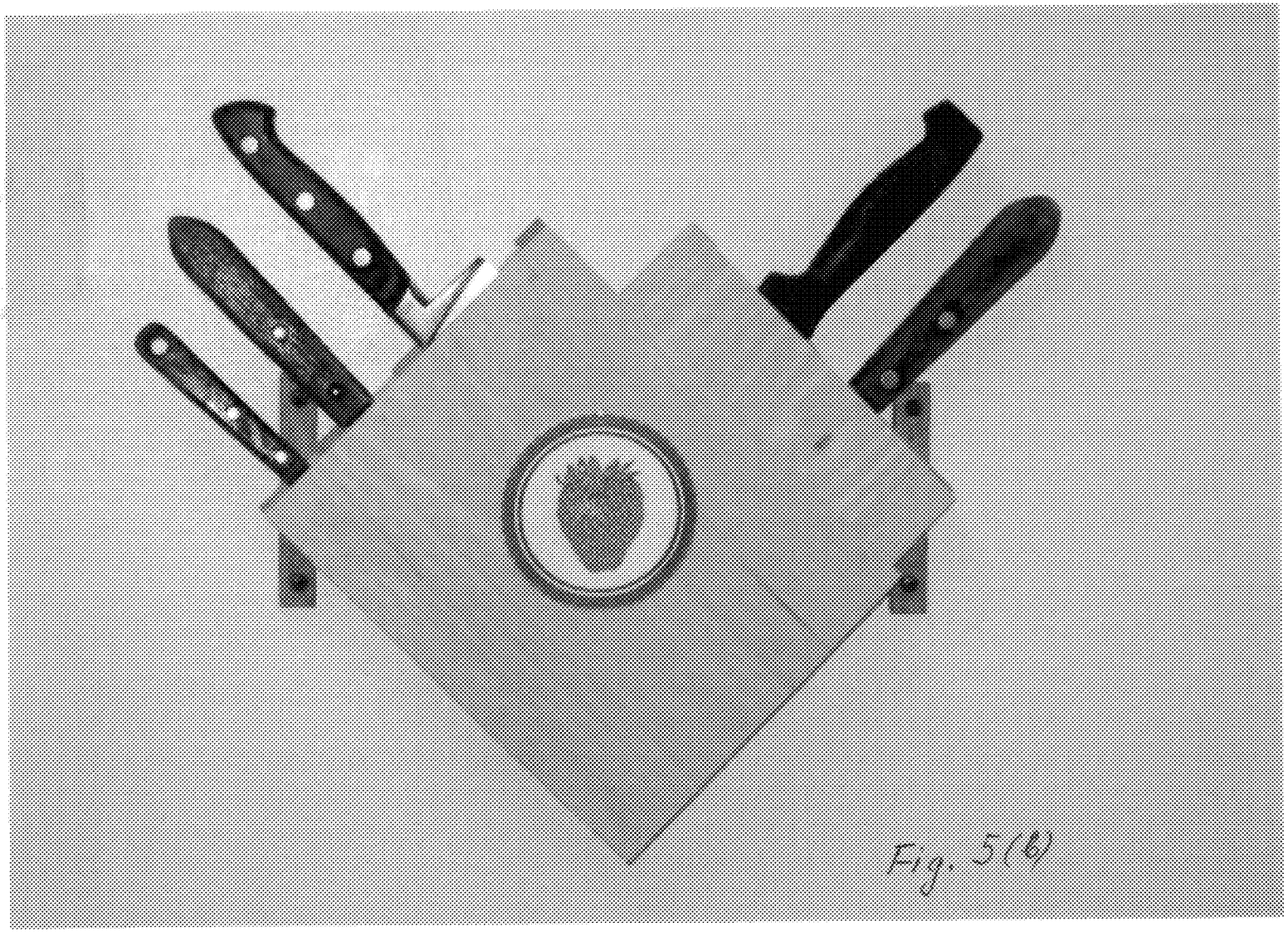
FIG. 5 is a photo of a prototype knife holder made in accordance with the present invention.

The inventor has implemented a prototype of the knife holder according to the current invention, and its photograph is shown in FIG. 5. The prototype has been in actual use and confirmed all advantages of the present invention.

We claim:

1. A compact knife holder, comprising:

a rear plate having a front side and a back side, wherein the rear plate is configured to constrain movement of a rear knife;

a front plate having a front side and a back side, wherein the front plate is configured to constrain movement of a front knife, the front plate is substantially parallel to the rear plate;

a middle plate in between the rear plate and the front plate, wherein the middle plate has a front side and a back side and is substantially parallel to the rear plate and the front plate;

a first rear spacer and a second rear spacer, wherein the first rear spacer and the second rear spacer are affixed to the front side of the rear plate and the back side of the middle plate;

the first rear spacer and the second rear spacer create a set of rear channels each having a width, wherein the set of rear channels are each configured to house a portion of a blade of the rear knife such that a handle of the rear knife is accessible outside the middle plate and the rear plate;

a first front spacer and a second front spacer, wherein the first front spacer and the second front spacer are affixed to the back side of the front plate and the front side of the middle plate;

the first front spacer and the second front spacer create a set of front channels each having a width, wherein the set of front channels are each configured to house a portion of a blade of the front knife such that a handle of the front knife is accessible outside the front plate and the middle plate;

the set of rear channels and the set of front channels are crisscrossed in substantially parallel, non-intersecting planes;

the rear channel is at an angle in a range of 10 degrees to 80 degrees or 100 degrees to 170 degrees relative to a horizontal plane; and the front channel is at an angle in a range of 10 degrees to 80 degrees or 100 degrees to 170 degrees relative to a horizontal plane.

2. The compact knife holder of claim 1, further comprising:

a third rear spacer; and the third rear spacer and at least one of the first rear spacer or the second rear spacer create a second rear channel of the set of rear channels, the second rear channel having a width, wherein the second rear channel is configured to house a portion of a blade of an additional knife such that a handle of the additional knife is accessible outside the rear plate and the middle plate.

3. The compact knife holder of claim 2, wherein the second rear channel is at an angle in a range of 10 degrees to 80 degrees or 100 degrees to 170 degrees relative to a horizontal plane.

4. The compact knife holder of claim 1, further comprising:

a third front spacer; and the third front spacer and at least one of the first front spacer or the second front spacer create a second front channel of the set of front channels, the second front channel having a width, wherein the second front channel is configured to house a portion of a blade of an additional knife such that a handle of the additional knife is accessible outside the front plate and the middle plate.

5. The compact knife holder of claim 4, wherein the second rear channel is at an angle in a range of 10 degrees to 80 degrees or 100 degrees to 170 degrees relative to the horizontal plane.

6. The compact knife holder of claim 1, further comprising:

a second middle plate in between the rear plate and the middle plate wherein the second middle plate has a front side and a back side and is substantially parallel to the rear plate, the front plate, and the middle plate;

a first middle spacer and a second middle spacer, wherein the first middle spacer and the second middle spacer are affixed to one of the following:

the front side of the rear plate and the back side of the second middle plate; or the front side of the second middle plate and the back side of the middle plate; and the first middle spacer and the second middle spacer create a set of middle channels each having a width, wherein the set of middle channels are configured to house a portion of a blade of an additional knife such that a handle of the additional knife is accessible outside the rear plate and the second middle plate.

7. The compact knife holder of claim 1, further comprising:

a second middle plate in between the front plate and the middle plate wherein the second middle plate has a front side and a back side and is substantially parallel to the rear plate, the front plate, and the middle plate;

a first middle spacer and a second middle spacer, wherein the first middle spacer and the second middle spacer are affixed to one of the following:

the back side of the front plate and the front side of the second middle plate; or the back side of the second middle plate and the front side of the middle plate; and the first middle spacer and the second middle spacer create a set of middle channels each having a width, wherein the set of middle channels are configured to house a portion of a blade of an additional knife such that a handle of the additional knife is accessible outside the front plate and the second middle plate.

8. The compact knife holder of claim 1, wherein the first front spacer, the second front spacer, the first rear spacer, and the second rear spacer are based at least in part on the thickness of one of the front knife and the rear knife.

9. The compact knife holder of claim 1, further comprising a hanging component coupled to the back side of the rear plate configured to affix the compact knife holder to a structure such that at least the front knife and the rear knife are retained by gravity when the compact knife holder is hung on the structure.

10. The compact knife holder of claim 9, wherein the hanging component is configured to align one or more of the front knife and the rear knife in a fashion whereby one or more of the front blade and the rear blade are substantially parallel to a plane coincident with the point of the structure with which the hanging component couples.

11. The compact knife holder of claim 1, further comprising one or more attachment components coupled to the front side of the front plate configured to retain a kitchen accessory.

12. The compact knife holder of claim 1, further comprising a decorative portion of the front side of the front plate.

13. The compact knife holder of claim 1, further comprising a picture frame coupled to the front side of the front plate.

14. The compact knife holder of claim 1, wherein at least one of the first rear spacer or the second rear spacer is made of a rear spacer material and at least one of the first front spacer or the second front spacer is made of a front spacer material, the rear spacer material is a different material than the front spacer material.

15. The compact knife holder of claim 1, wherein the rear plate is made of a first material and the front plate is made of a second material.

16. The compact knife holder of claim 1, wherein the middle plate is made of a middle plate material, the middle plate material is one of the first material, the second material, or a third material.

* * * * *